US005818152A

United States Patent [19]

Bolduan et al.

[11] Patent Number: 5,818,152

[45] Date of Patent: Oct. 6, 1998

[54] SPARK PLUG FOR AN INTERNAL COMBUSTION ENGINE

[75] Inventors: Gunter Bolduan, Langen; Dittmar Klett, Pleidelsheim; Jurgen Wurth, Heilbronn; Oswald Glaser, Beuren; Hermann Kersting, Ludwigsburg; Roland Muller, Murr, all of Germany

[73] Assignee: General Motors Corporation, Detroit, Mich.

[21] Appl. No.: 599,499

[22] Filed: Jan. 24, 1996

[30] Foreign Application Priority Data

Feb. 2, 1995 [DE] Germany ..... 195 03 223.3

[51] Int. Cl.[6] ..... H01T 13/20

[52] U.S. Cl. ..... 313/141; 313/141; 313/143; 313/142

[58] Field of Search ..... 313/141, 143, 313/142, 123, 130, 131

[56] References Cited

U.S. PATENT DOCUMENTS 3,313,972 4/1967 Beesch ..... 313/131
3,725,715 4/1973 Krow ..... 313/131
3,870,918 3/1975 Senda et al. ..... 313/141
5,189,333 2/1993 Kagawa et al. ..... 313/143

*Primary Examiner*—Sandra L. O'Shea
*Assistant Examiner*—Joseph Williams
*Attorney, Agent, or Firm*—Anthony Luke Simon

[57] ABSTRACT

A spark plug for an internal combustion engine comprising: a cylindrical metal tube; a rod-shaped central electrode within the cylindrical metal tube; a tubular insulator within which the rod-shaped central electrode is located, wherein the tubular insulator is arranged substantially centrally in and substantially coaxially with the cylindrical metal tube; and at least two ground electrodes affixed to the cylindrical metal tube, wherein the at least two ground electrodes are each bent toward the metal electrode, wherein each ground electrode together with the central electrode forms a different member of a set of spark paths comprising: (i) an air sliding spark path, (ii) and air-air sliding spark path and (iii) an air spark path.

1 Claim, 2 Drawing Sheets

SPARK PLUG FOR AN INTERNAL COMBUSTION ENGINE

BACKGROUND OF THE INVENTION

The invention relates to a spark plug for internal combustion engines such as is already known from EP 0 470 688. This known spark plug consists of a cylindrical metal tube in which a tubular ceramic insulator is arranged. The ceramic insulator extends out of the cylindrical metal tube and contains the rod-shaped central electrode of the spark plug, the end of the central electrode in turn extending out of the tubular insulator. In addition, on the cylindrical metal tube which represents the housing of the spark plug, several ground electrodes are affixed which are bent toward the central electrode. The individual ground electrodes of the spark plug are so arranged relative to the central electrode that two spark paths are formed between the ground electrode and the central electrode. The curved end segment of the ground electrode is arranged to the side of the jacket surface of the central electrode so that between the end segment of the ground electrode and the central electrode, a first spark path, the so-called air spark gap, is formed. At the same time a second spark path is formed due to the fact that the spark emerges from the central electrode, slides over the surface of the insulator and jumps to the ground electrode at the narrowest gap between the insulator and ground electrode. This second spark path therefore is composed of the air gap and a sliding path and forms an air-sliding spark gap. This spark plug is therefore also called an air-air sliding spark spark plug in the technical world. Other spark plugs are known in which only a similar air spark is formed.

SUMMARY OF THE INVENTION

The spark plug according to the invention has the advantage that, as a result of the parallel wiring of two ground electrodes in each case, each of which together with the central electrode forms a different type of spark gap, improved spark plug performance is realized. For example, the reduced efficiency in spark formation occasionally occurring between the ground and central electrode in air spark spark plugs under certain operating conditions is compensated by a different type of spark path between the other ground electrode and the central electrode. The spark plug according to the invention therefore has the advantage that, through the combination of known spark plug designs, the disadvantages of any single design are eliminated.

By various preferred examples of this invention, additional advantages are realized. It is especially advantageous that, as a result of the combination of a ground electrode pair with the formation of an air-sliding spark gap with an electrode pair which forms an air-air sliding spark gap, the disadvantages of one spark gap design are eliminated by the second design. Thus, for example, an air-air sliding spark gap has a high service life and good cold starting behavior, but under certain operating conditions the exhaust gas behavior may not be optimal. As opposed to this, the design of an air sliding spark has a very good flame core formation and therefore a very good exhaust gas behavior. With the approach according to this invention, it is possible to eliminate the disadvantages of one spark plug design by the combination of at least two spark plug designs in the same spark plug.

Advantageously then, a preferred example spark plug for an internal combustion engine according to this invention comprises: a cylindrical metal tube; a rod-shaped central electrode within the cylindrical metal tube; a tubular insulator within which the rod-shaped central electrode is located, wherein the tubular insulator is arranged substantially centrally in and substantially coaxially with the cylindrical metal tube; and at least two ground electrodes affixed to the cylindrical metal tube, wherein the at least two ground electrodes are each bent toward the metal electrode, wherein each ground electrode together with the central electrode forms a different member of a set of spark paths comprising: (i) an air sliding spark path, (ii) an air-air sliding spark path and (iii) an air spark path.

BRIEF DESCRIPTION OF THE DRAWINGS

The invention will now be described by way of example with reference to the following drawings, in which.

DETAILED DESCRIPTION OF THE INVENTION

All of the spark plug end segments shown in the examples basically have the same design. The only difference in each case is the formation of the ground electrodes. Here, as a result of different positionings of the ground electrode end segments relative to the central electrode or the insulator, different spark paths are formed. The fundamental design, however, is common to all of the spark plug end segments shown. For better representation, the spark plugs are shown in a semi-cutaway view.

The spark plugs in this case consist of a cylindrical metal tube 1 which represents the housing of the spark plug. In this cylindrical metal tube 1, a tube-shaped insulator 2 is positioned in which the rod-shaped central electrode 3 is arranged centrally. The cylindrical metal tube 1, the insulator 2 and the central electrode 3 in this case are coordinated with one another in such a way that their long axes of rotational symmetry lie one above the other. At the end of the cylindrical metal tube 1, the ground electrodes 4 are affixed, the ground electrodes initially running in the direction of the cylindrical metal tube 1 and then are bent or curved toward the insulator and the central electrode.

Figure 1A:
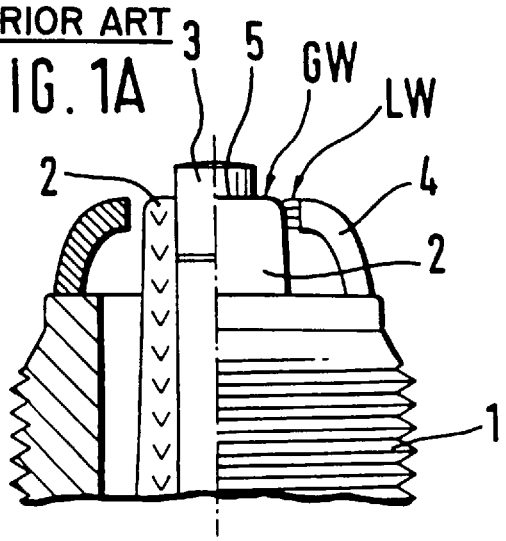
PRIOR ART FIG. 1A
FIG. 1A shows a side view of an end segment of a spark plug with an air-sliding spark gap.
Figure 1B:
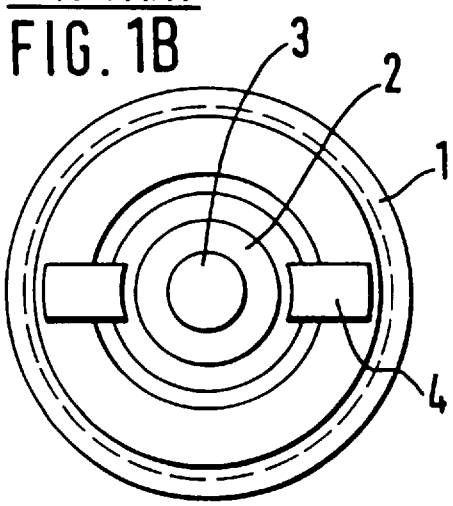
PRIOR ART FIG. 1B
FIG. 1B shows the top view of the spark plug end segment in FIG. 1A.

In FIG. 1A, the side view, and in FIG. 1B, the top view, the spark plug end segment is shown with the development of an air sliding spark. In this case the bent part of the ground electrode is shaped in such a way that the outer surface of the bent part of the ground electrode 4 is flush with the upper edge of the insulator 5. Therefore, the spark path is such that the spark initially emerges from the central electrode 3, then slides over the insulator 2 and, at the smallest distance between insulator and end segment of the ground electrode, it jumps to the ground electrode. Such a spark is called an air-sliding spark because the spark path consists of two parts, the air path from the ground electrode to the insulator and the sliding path on the surface of the insulator to the central electrode.

Figure 2A:
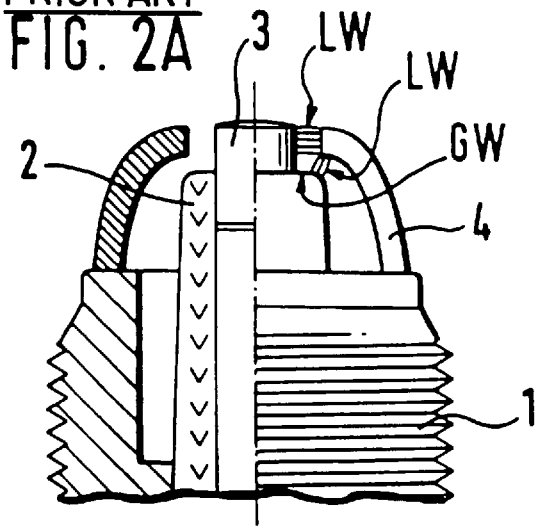
PRIOR ART FIG. 2A
FIG. 2A is a side view of an end segment of a spark plug with an air-air sliding spark gap.
Figure 2B:
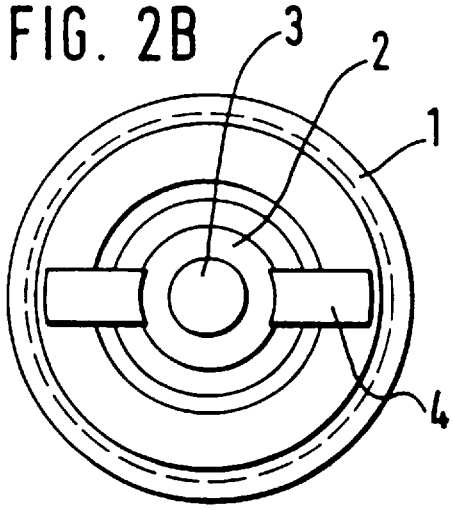
PRIOR ART FIG. 2B
FIG. 2B shows the top view of the spark plug end segment in FIG. 2A.

FIG. 2A shows a side view and FIG. 2B shows the top view of a so-called air-air sliding spark spark plug. This term results from the fact that, on this spark plug, two sparks are formed with different spark paths. The ground electrode is designed in this case in such a way that the bent end segment of the ground electrode lies opposite the jacket surface of the central electrode. The distance between the ground electrode and the central electrode and therefore the path of the air spark corresponds approximately to the spark path of the air sliding spark that emerges from the center of the electrode, slides over the insulator and jumps to the ground electrode at the narrowest gap between the insulator and ground electrode. Since the two spark paths are of approximately the same length, it is assured that in this spark plug two spark paths will be formed.

More particularly, the first of the two paths comprises the pure air paths from the central electrode to the ground electrode in FIG. 2A, denoted by the reference symbol LW. At the same time a second spark path is formed that is composed of a sliding path GW and an air path LW. Therefore, the spark emerges from the central electrode, slides over the surface of the insulator and jumps at the point of smallest distance between insulator and ground electrode to the ground electrode. Since the second spark path consists of a sliding path and an air path, one speaks of an air-sliding spark and the spark plug is called an air-air sliding spark spark plug.

Figure 3A:
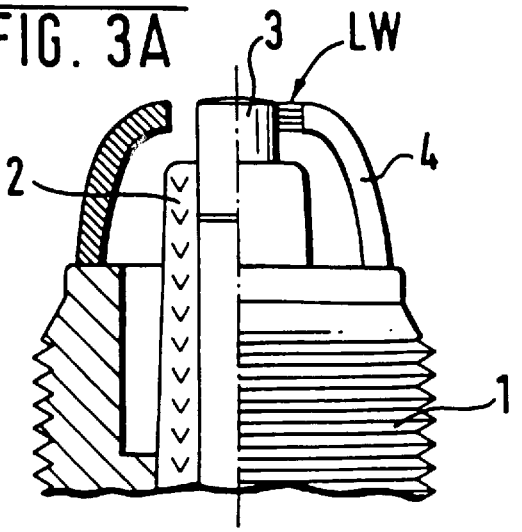
PRIOR ART FIG. 3A
FIG. 3A is a side view of the end segment of a spark plug with an air spark gap.
Figure 3B:
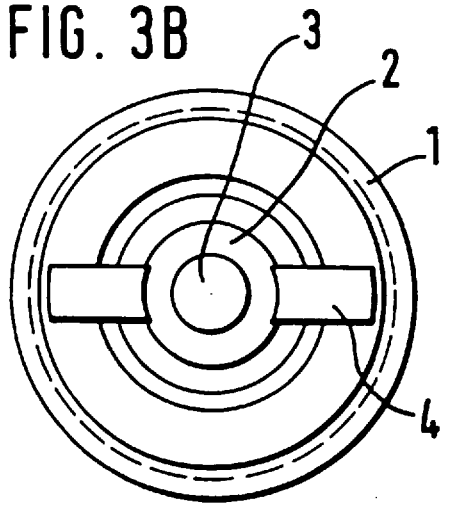
PRIOR ART FIG. 3B
FIG. 3B shows the top view of the spark plug end segment in FIG. 3A.

In FIG. 3A, the side view, and in FIG. 3B, the top view, a spark plug end segment with an air spark is shown. In this case, the ground electrode is also bent in such away that the end segment of the ground electrode lies opposite the jacket surface of the central electrode. At the same time, however, the distance from the ground electrode to the insulator is selected to be so great that no spark jumps from the insulator to the ground electrode. Therefore on this spark plug only a spark path from the central electrode to the ground electrode is formed. This spark plug is called an air spark spark plug.

Figure 4:
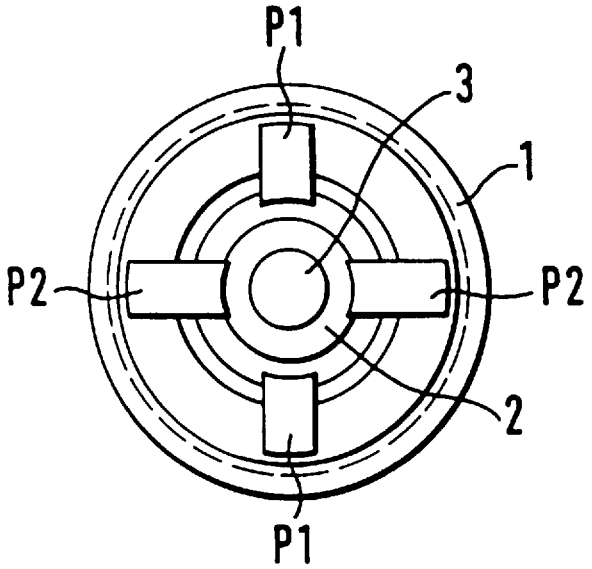
FIG. 4 is the top view of a spark plug with a combination of air sliding sparks and air sparks, with two ground electrodes for each type of spark path.

FIG. 4 shows the top view of the end segment of an example spark plug according to this invention. In this example, on the cylindrical metal tube 1 in each case opposite one another, ground electrodes are installed each of which leads to the formation of the same spark path. In the structure shown, on the circumference of the cylindrical metal tube 1, ground electrodes are arranged at a distance from each other of 90° in an alternating arrangement of different spark paths. In an alternative example, for each spark path, a single electrode is provided so that then two ground electrodes are affixed to the housing which are arranged opposite each other.

In FIG. 4, a ground electrode pair P1, which forms air spark paths (i.e., described above with reference to FIGS. 3*a* and 3*b*), and a ground electrode pair P2, which form air sliding spark paths (i.e., described above with reference to FIGS. 1*a* and 1*b*), are combined with one another. Thus the spark plug shown has parallel operating air spark paths on one electrode pair P1 and air sliding spark paths on the second electrode pair P2.

Figure 5:
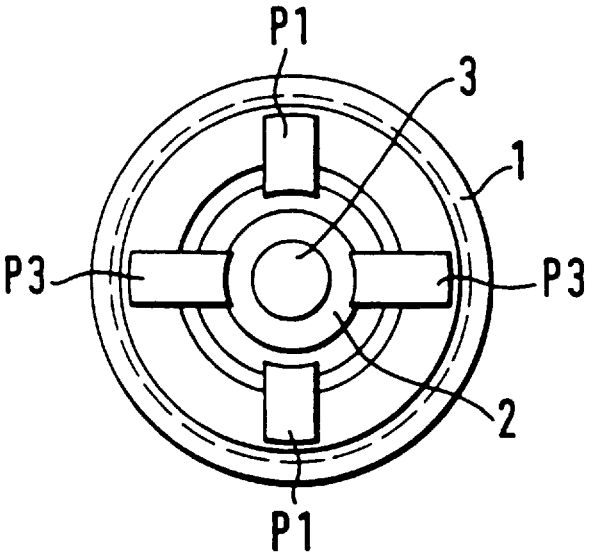
FIG. 5 is the top view of a spark plug realizing an air sliding spark and an air-air sliding spark with two ground electrodes per each type of spark path.

In FIG. 5 also, two ground electrode pairs, each pair forming a different spark path, are combined. As in FIG. 4, the individual ground electrodes that belong to the same pair are arranged opposing one another so that circumferentially neighboring ground electrodes do not form the same spark path. In FIG. 5 the ground electrode pair P1, which form air sliding spark paths (i.e., described above with reference to FIGS. 1*a* and 1*b*), is combined with ground electrode pair P3, which forms air-air sliding spark paths (i.e., described above with reference to FIGS. 2*a* and 2*b*). Thus the spark plug shown has parallel operating air sliding spark paths on electrode pair P1 and air-air sliding spark paths on electrode pair P2.

Figure 6:
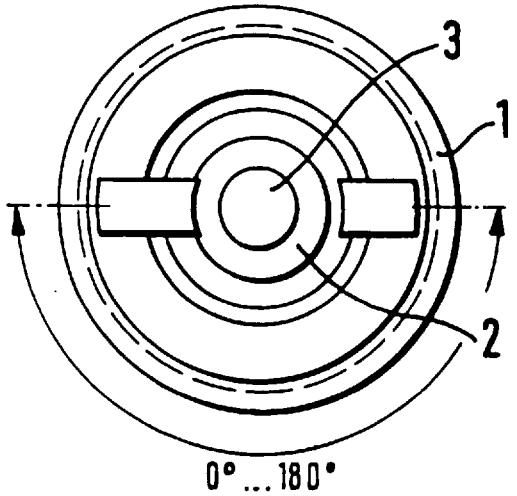
FIG. 6 is a spark plug as in FIG. 5 with one ground electrode each for each type of spark path.

FIG. 6 shows a spark plug that forms an air sliding spark and an air-air sliding spark as already described for FIG. 5. In FIG. 6, though each spark path has one ground electrode as opposed to a pair of ground electrodes as shown in FIG. 5. The angle separating the individual ground electrodes can be arbitrary, the ground electrodes preferably being arranged at an angle of 180°. Thus the spark plug shown has an air sliding spark path operating in parallel with an air-air sliding spark path.

We claim:

1. A spark plug for an internal combustion engine comprising:

a cylindrical metal tube;

a rod-shaped central electrode within the cylindrical metal tube;

a tubular insulator within which the rod-shaped central electrode is located, wherein the tubular insulator is arranged substantially centrally in and substantially coaxially with the cylindrical metal tube;

a first ground electrode affixed to the cylindrical metal tube, wherein the first ground electrode together with the central electrode form a first spark path of a first type comprising an air-air sliding spark path; and a second ground electrode affixed to the cylindrical metal tube, wherein the second ground electrode together with the central electrode form a second spark path of a second type comprising an air sliding spark path, wherein during normal spark plug operation, the first and second spark paths operate in parallel creating first and second spark path firing patterns.

* * * * *

UNITED STATES PATENT AND TRADEMARK OFFICE

CERTIFICATE OF CORRECTION

PATENT NO. : 5,818,152

DATED : October 6, 1998

INVENTOR(S) : Bolduan et al.

It is certified that error appears in the above-indentified patent and that said Letters Patent is hereby corrected as shown below:

On the title page: Item [73], change Assignee from "General Motors Corporation, Detroit, Mich." to:

-- General Motors Corporation, Detroit, Michigan and Robert Bosch gmBh, Stuttgart, Germany--

Signed and Sealed this

Thirteenth Day of March, 2001

*Attest:*

Nicholas P. Godici

NICHOLAS P. GODICI

*Attesting Officer*

*Acting Director of the United States Patent and Trademark Office*